US009457881B1

(12) United States Patent
Belter et al.

(10) Patent No.: US 9,457,881 B1
(45) Date of Patent: Oct. 4, 2016

(54) OUTBOARD MARINE ENGINES HAVING A BEDPLATE AND COVER ASSEMBLY

(71) Applicant: Brunswick Corporation, Lake Forest, IL (US)

(72) Inventors: David J. Belter, Oshkosh, WI (US); Gregg D. Langenfeld, Fond du Lac, WI (US); George D. Idzikowski, Lomira, WI (US)

(73) Assignee: Brunswick Corporation, Lake Forest, IL (US)

( * ) Notice: Subject to any disclaimer, the term of this patent is extended or adjusted under 35 U.S.C. 154(b) by 317 days.

(21) Appl. No.: 14/195,115

(22) Filed: Mar. 3, 2014

Related U.S. Application Data

(60) Provisional application No. 61/787,699, filed on Mar. 15, 2013.

(51) Int. Cl.

| | |
|---|---|
| ***F01M 5/00*** | (2006.01) |
| ***F01M 11/02*** | (2006.01) |
| ***B63H 20/00*** | (2006.01) |
| ***F01M 1/00*** | (2006.01) |

(52) U.S. Cl.
CPC ..... *B63H 20/001* (2013.01); *F01M 1/00* (2013.01); *F01M 5/002* (2013.01); *F01M 11/02* (2013.01)

(58) Field of Classification Search
CPC ..... F01M 1/00; F01M 5/002; F01M 2011/0033; F01M 11/02; F01M 2011/023; F01M 2011/026; B63H 20/001
See application file for complete search history.

(56) References Cited

U.S. PATENT DOCUMENTS

| | | | | |
|---|---|---|---|---|
| 4,771,745 | A | 9/1988 | Nakamura et al. | |
| 5,452,692 | A | 9/1995 | Spray et al. | |
| 5,687,686 | A | 11/1997 | Takahashi | |
| 5,934,957 | A * | 8/1999 | Sato | F01M 5/002 440/88 J |
| 6,076,495 | A | 6/2000 | Takahashi et al. | |
| 6,286,476 | B1 * | 9/2001 | Hiraoka | F01M 11/02 123/196 R |
| 7,086,915 | B2 | 8/2006 | Hikosaka et al. | |
| 7,198,019 | B1 | 4/2007 | Belter | |
| 8,479,691 | B1 * | 7/2013 | Taylor | F01P 3/202 123/41.29 |

* cited by examiner

*Primary Examiner* — Lindsay Low
*Assistant Examiner* — Jacob Amick
(74) *Attorney, Agent, or Firm* — Andrus Intellectual Property Law, LLP

(57) ABSTRACT

An outboard marine engine has an engine block; a crankcase on the engine block; a crankshaft disposed in the crankcase for rotation about a crankshaft axis; a cover on the crankcase; a bedplate disposed between the engine block and the cover, the bedplate having a plurality of bearings for supporting rotation of the crankshaft; and a cooling water jacket that extends parallel to the crankshaft axis along a radially outer portion of the plurality of bearings. The cooling water jacket carries cooling water for cooling the plurality of bearings and at least one oil drain-back area is located adjacent to the cooling water jacket. The at least one oil drain-back area drains oil from the crankcase.

18 Claims, 15 Drawing Sheets

OUTBOARD MARINE ENGINES HAVING A BEDPLATE AND COVER ASSEMBLY

CROSS REFERENCE TO RELATED APPLICATION

The present utility patent application claims the benefit of and priority to U.S. Provisional Patent Application Ser. No. 61/787,699, filed Mar. 15, 2013, which is incorporated herein by reference.

FIELD

The present disclosure generally relates to outboard marine engines and more particularly to bedplate and cover assemblies for vertical shaft outboard marine engines having at least one cooling water jacket and at least one oil drain-back area located adjacent to bearings for a crankshaft.

BACKGROUND

U.S. Pat. No. 7,198,019 is incorporated herein by reference and discloses a lubricating system for a marine engine. The lubricating system provides a lubrication deflector which extends from the cylinder block of the engine toward rotating surfaces of a crankshaft and/or connecting rod. A lubrication drainage passage is provided as an integral part of a cylinder block of the marine engine to direct a flow of liquid lubricant away from the lubrication deflectors and downwardly toward a lubrication reservoir, or sump. The passage is located away from the rotating crankshaft and reciprocating connecting rods.

SUMMARY

This Summary is provided to introduce a selection of concepts that are further described hereinbelow in the Detailed Description. This Summary is not intended to identify key or essential features of the claimed subject matter, nor is it intended to be used as an aid in limiting scope of the claimed subject matter.

In certain examples, an outboard marine engine comprises: an engine block; a crankcase on the engine block; a crankshaft disposed in the crankcase for rotation about a crankshaft axis; a cover on the crankcase; a bedplate disposed between the engine block and the cover, the bedplate having a plurality of bearings for supporting rotation of the crankshaft; and a cooling water jacket that extends parallel to the crankshaft axis along a radially outer portion of the plurality of bearings. The cooling water jacket carries cooling water for cooling the plurality of bearings. At least one oil drain-back area is located adjacent to the cooling water jacket. The at least one oil drain-back area drains oil from the crankcase.

In certain examples an outboard marine engine comprises a cover that extends along a row of piston-cylinders on an engine block. The cover at least partially defines a cooling water jacket and also has an inner surface that defines at least one oil drain-back area for receiving and draining oil that is radially thrown from a crankshaft during operation of the outboard marine engine.

In certain examples, an outboard marine engine comprises a crankshaft, an engine block that has a row of radially extending piston-cylinders, a bedplate having a radially inner side that is fastened to the engine block; and a cover having a radially inner surface that is fastened to a radially outer surface of the bedplate. The cover and the bedplate at least partially define a cooling water jacket that carries cooling water for cooling bearings of a crankshaft. The bedplate and the radially inner side of the cover together define at least one oil drain-back area for receiving and draining oil that is radially thrown from a crankshaft during rotation.

BRIEF DESCRIPTION OF THE DRAWINGS

Examples of apparatuses for outboard marine engines are described with reference to the following drawing figures. The same numbers are used throughout the drawing figures to reference like features and components.

DETAILED DESCRIPTION OF THE DRAWINGS

Figure 1:
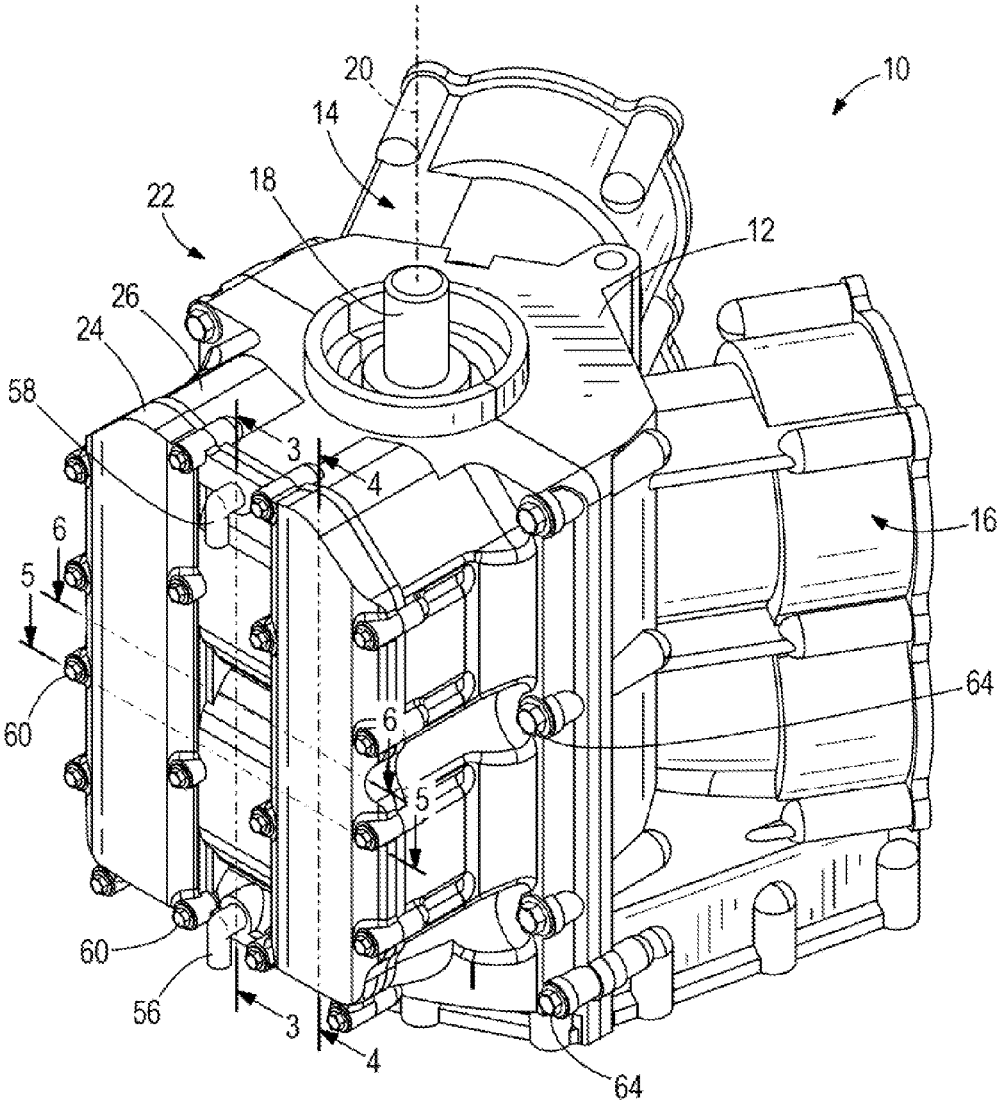
FIG. 1 is a perspective view of a first example of an outboard marine engine, including an engine block, bedplate, and cover assembly

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

During research and experimentation with lubricating systems and cooling systems for marine engines, the present inventors have identified two problems. The first is that relatively high oil temperature in the engine environment can cause the oil to quickly degrade and can also increase the temperature of seals and other components within the engine. The high temperatures require more robust seals and components, thus adding cost. The second problem identified by the inventors is that windage friction in the crankcase of the engine causes a loss of power. Windage friction is affected by the amount of oil that flows through the main bearings and subsequently into the crankcase and the rotating and reciprocating cranktrain.

The present disclosure provides increased oil drain-back areas and increased water cooling areas, as compared to prior art arrangements. The inventors have found that more effectively cooling the main bearing bulkheads in the crankcase reduces thermal expansion of the bulkheads, which in turn reduces the running clearances of the main bearings. This results in less oil flow, which leads to cooler oil and less power lost to friction. The present disclosure incorporates the noted oil drain-back areas, which allow for shorter bulkheads and thus lighter weight. Those having ordinary skill in the art would recognize the cost and performance advantages that follow from the above mentioned features.

FIGS. 1-6 depict one example of an outboard marine engine 10 according to the present disclosure. The outboard marine engine 10 includes an engine block 12 on which first and second rows of vertically-aligned piston-cylinders 14, 16 are mounted transversely to each other in a conventional V-style orientation. The example shown in FIGS. 1-6 is a 4-cylinder arrangement; however the concepts of the present disclosure are equally applicable to single cylinder engine arrangements, and engine arrangements having more piston-cylinders, such as 6-cylinder examples, 8-cylinder examples, and/or the like. The concepts of the present disclosure are equally applicable to incline engines, boxer engines and/or the like. Combustion within the first and second rows of aligned piston-cylinders 14, 16 induces reciprocal movement of connecting rods (not shown), which causes rotation of a crankshaft 18 about its crankshaft axis 20. The crankshaft 18 is disposed in a crankcase 22 on the engine block 12. A cover 24 is provided on the crankcase 22. A bedplate 26 is disposed between the engine block 12 and the cover 24. The bedplate 26 and the cover 24 at least partially define the extent of the crankcase 22 in which the crankshaft 18 is disposed. The cover 24 is connected to the bedplate 26 by bolts 60 that extend through bolt holes 62 in the cover 24 and thread into the bedplate 26. The bedplate 26 is connected to the engine block 12 by bolts 64 that extend through bolt holes 66 in the bedplate 26. To maintain clarity on the drawings, not all the bolts 60, 64 and bolt holes 62, 66 are numbered.

Figure 2:
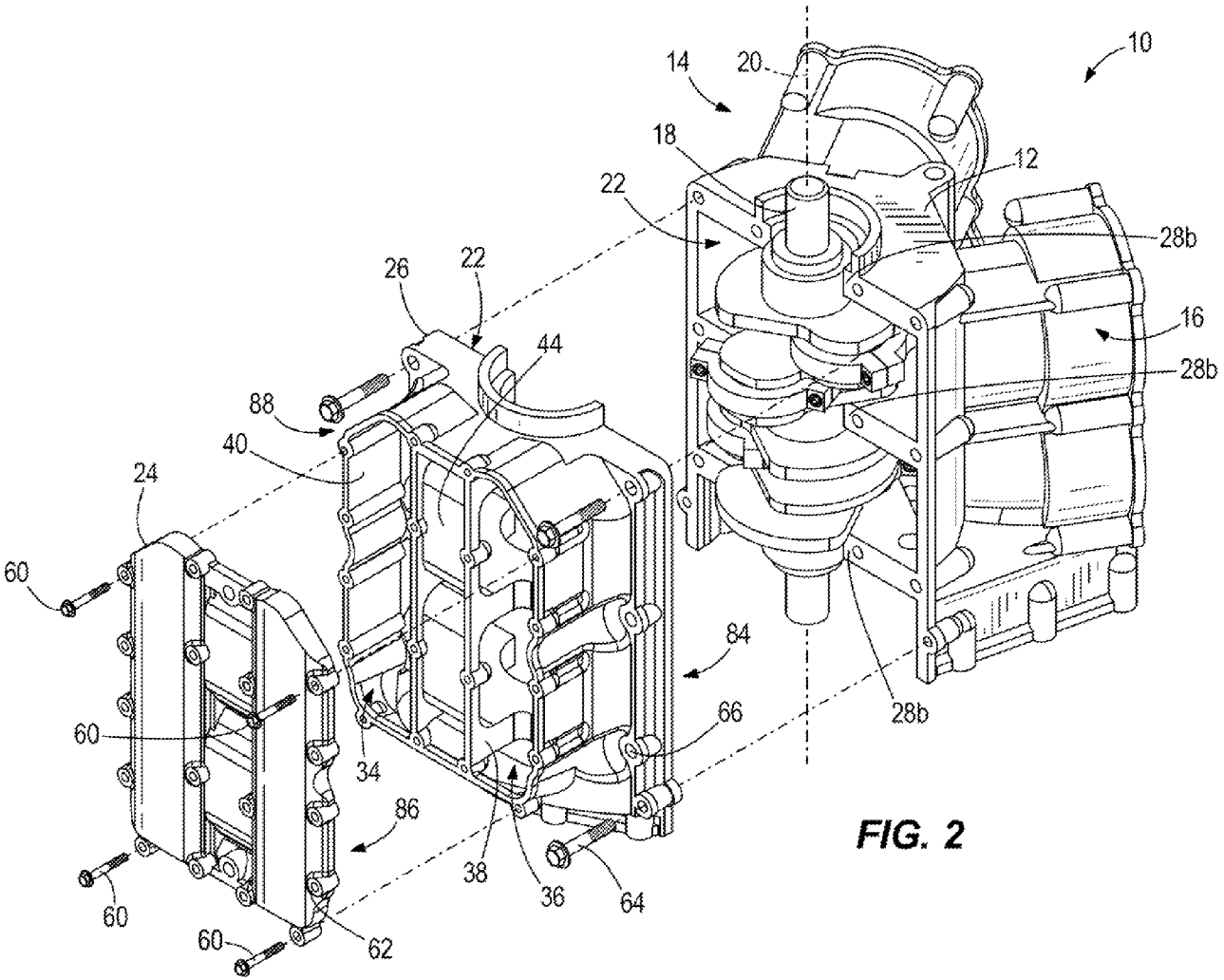
FIG. 2 is an exploded view of the assembly of FIG. 1.
Figure 3:
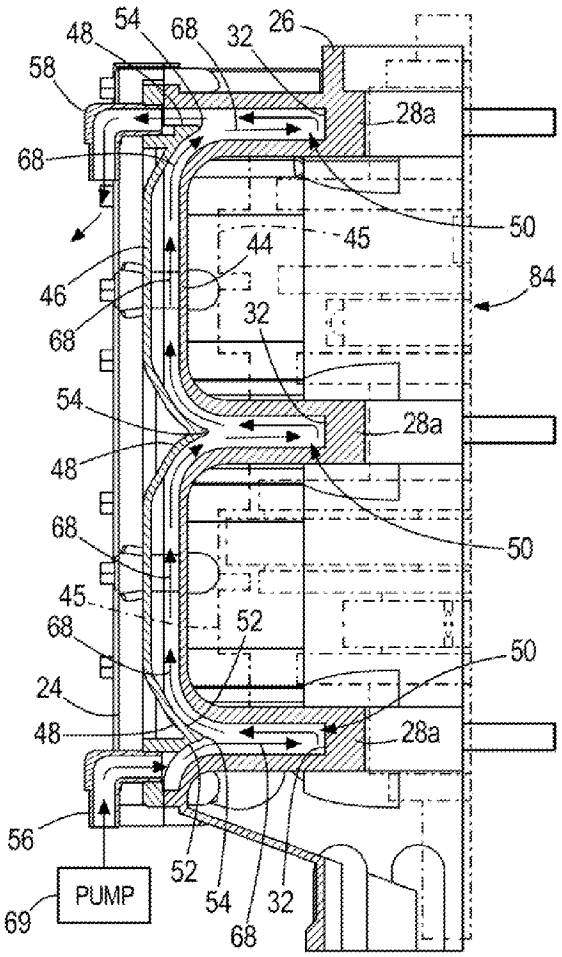
FIG. 3 is a view of section 3-3, taken in FIG. 1.
Figure 3A:
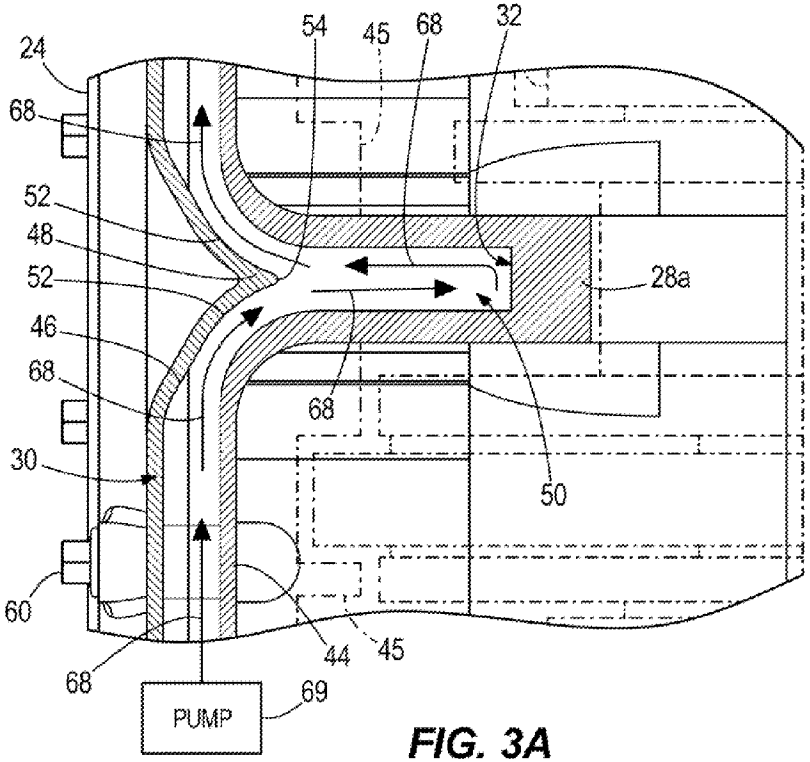
FIG. 3A is a closer view of a portion of FIG. 3.

As shown in FIGS. 2-3A, the bedplate 26 defines part of a plurality of vertically aligned bearings 28*a*, 28*b* for supporting rotation of the crankshaft 18. In this example, the bedplate 26 forms a radially outer first half 28*a* of the plurality of bearings 28*a*, 28*b* and the engine block 12 defines a radially inner second half 28*b* of the plurality of bearings 28*a*, 28*b*.

As shown in FIGS. 3 and 3A, a cooling water jacket 30 conveys/carries cooling water for cooling each of the bearings 28*a*, 28*b*. More specifically, the cooling water jacket 30 extends generally parallel to the crankshaft axis 20 alongside of and adjacent to radially outer portions 32 of each of the bearings 28*a*, 28*b*, respective to the crankshaft 18 and piston-cylinders 14, 16. The cooling water jacket 30 has a radially outwardly directed cooling water jacket surface 44 and an opposing radially inwardly directed cooling water jacket surface 46 that is aligned with and faces the outwardly directed cooling water jacket surface 44. A plurality of deflectors 48 are spaced apart along the inwardly directed cooling water jacket surface 46. The deflectors 48 extend into a plurality of recesses 50 formed in the outwardly directed cooling water jacket surface 44. Each recess 50 is located adjacent to one of the bearings 28 such that the deflectors 48 deflect flow of cooling water into and out of each of the recesses 50, adjacent to each of the bearings 28. The deflectors 48 include at least one radially inwardly curved surface 52 that ends at a peak 54 located in a respective recess 50. Some of the deflectors 48 include a pair of opposing radially inwardly directed curved surfaces 52 that merge at the peak 54.

In this example, the cooling water jacket 30 is partially defined by the bedplate 26 and partially defined by the cover 24. More specifically, the outwardly directed cooling water jacket surface 44 is provided by the bedplate 26 and the inwardly directed cooling water jacket surface 46 is provided by the cover 24. A cooling water inlet 56 is located at a lower end of the cooling water jacket 30. A cooling water outlet 58 is located at an upper end of the cooling water jacket 30. Cooling water flows vertically upwardly through the cooling water jacket 30 from the cooling water inlet 56 to the cooling water outlet 58, as shown at arrows 68.

Figure 4:
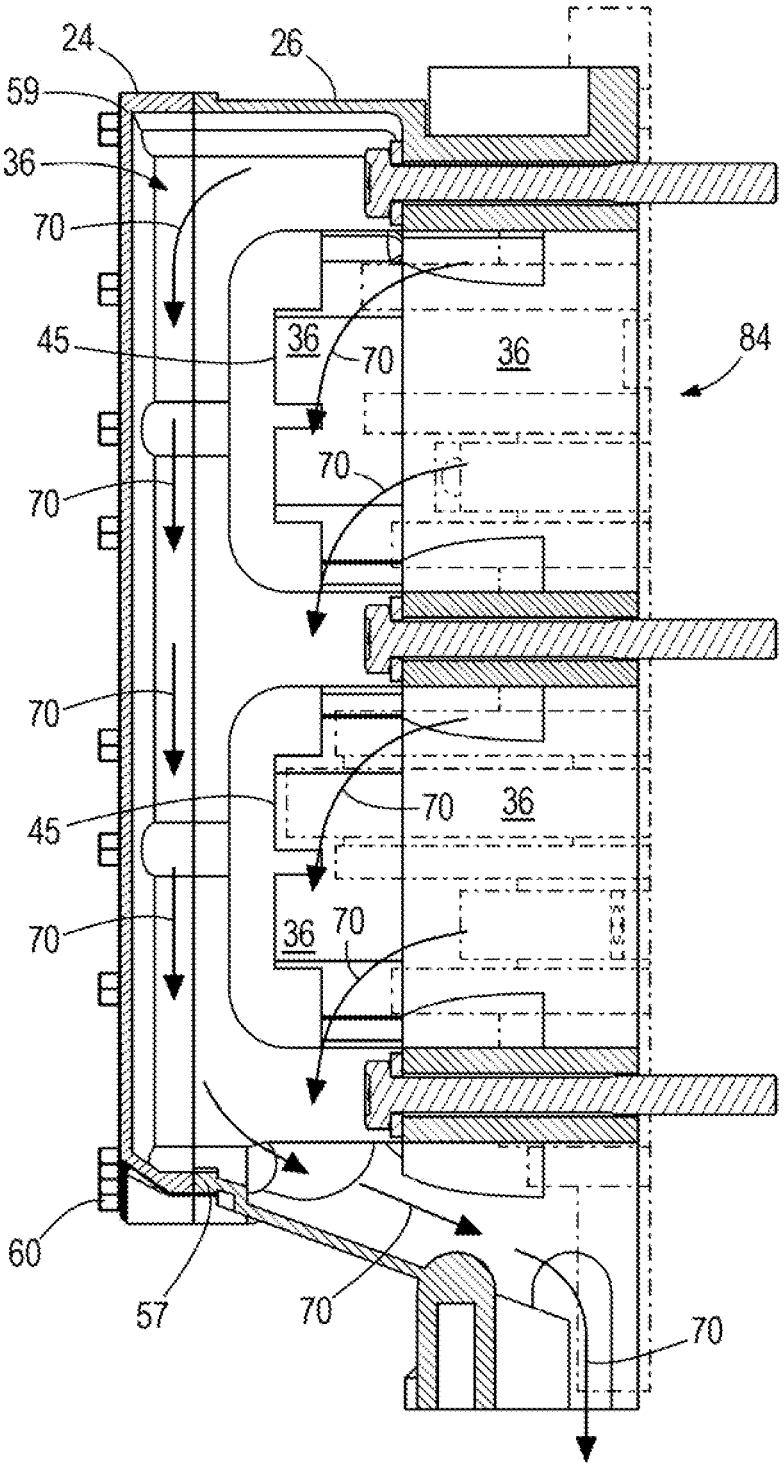
FIG. 4 is a view of section 4-4, taken in FIG. 1.
Figure 5:
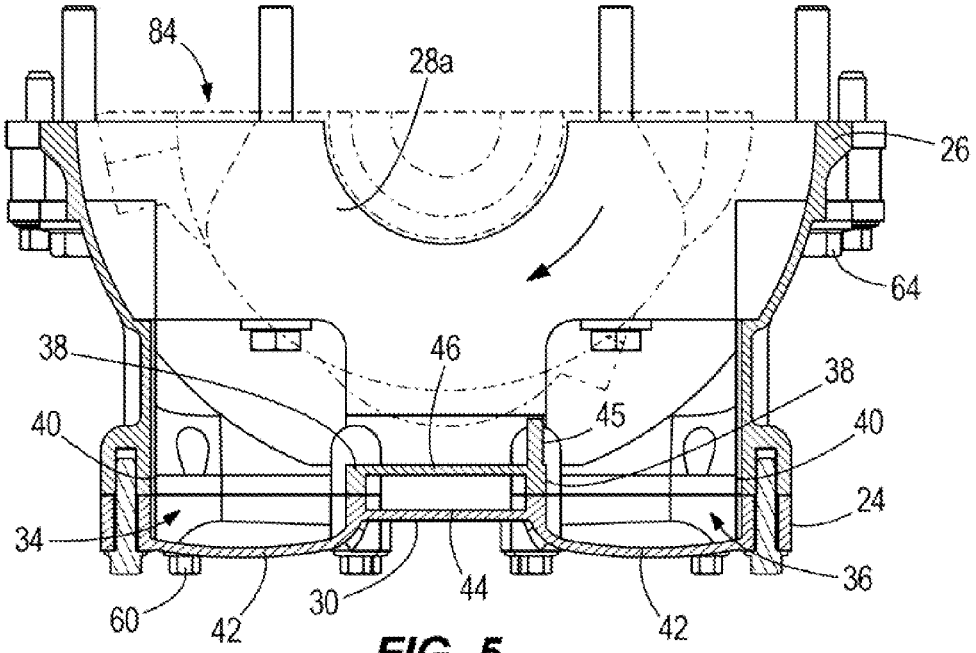
FIG. 5 is a view of section 5-5, taken in FIG. 1.
Figure 6:
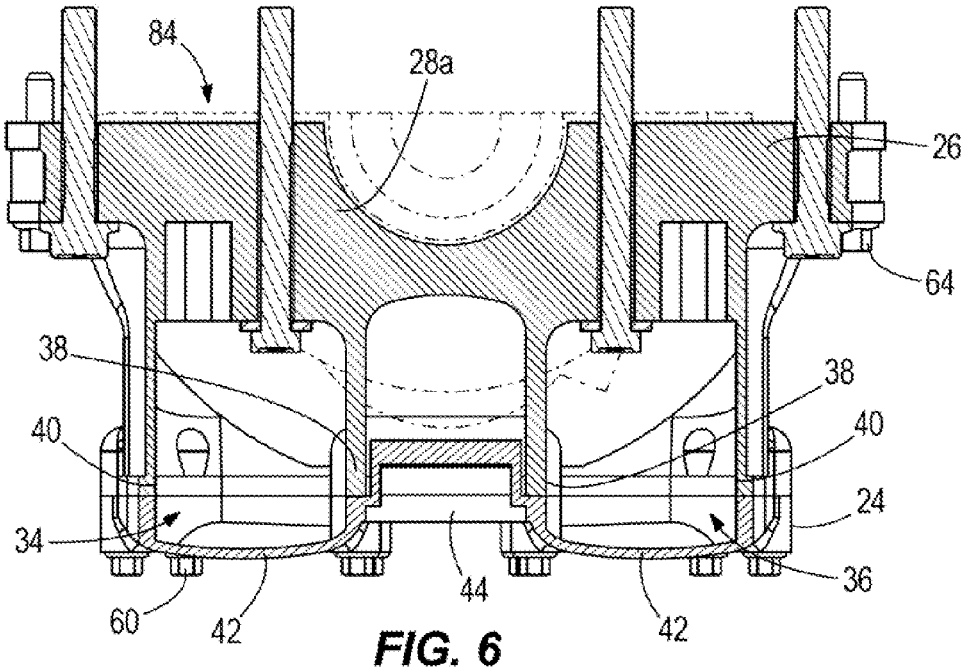
FIG. 6 is a view of section 6-6, taken in FIG. 1.
Figure 7:
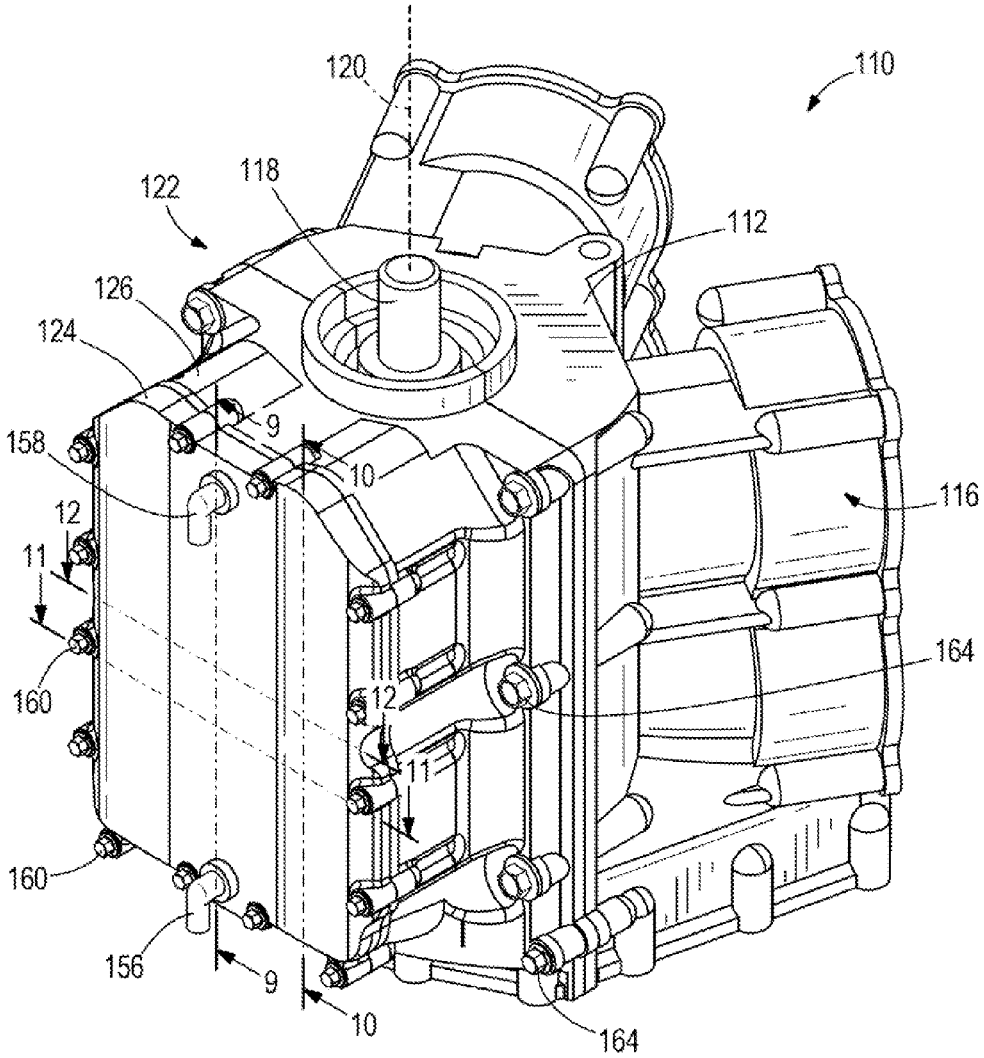
FIG. 7 is a perspective view of a second example of an outboard marine engine, including an engine block, bedplate, and cover assembly
Figure 8:
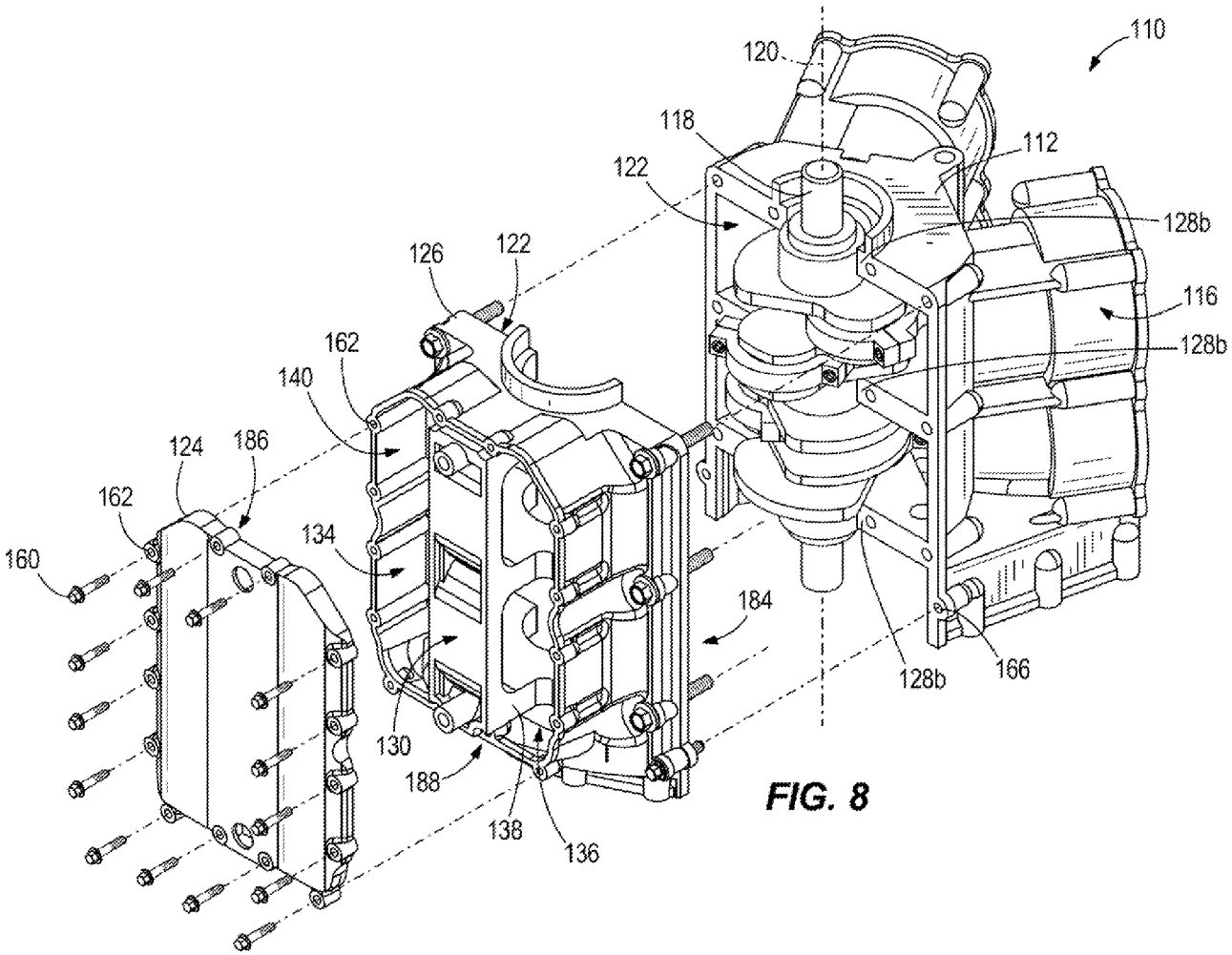
FIG. 8 is an exploded view of the assembly of FIG. 7.
Figure 9:
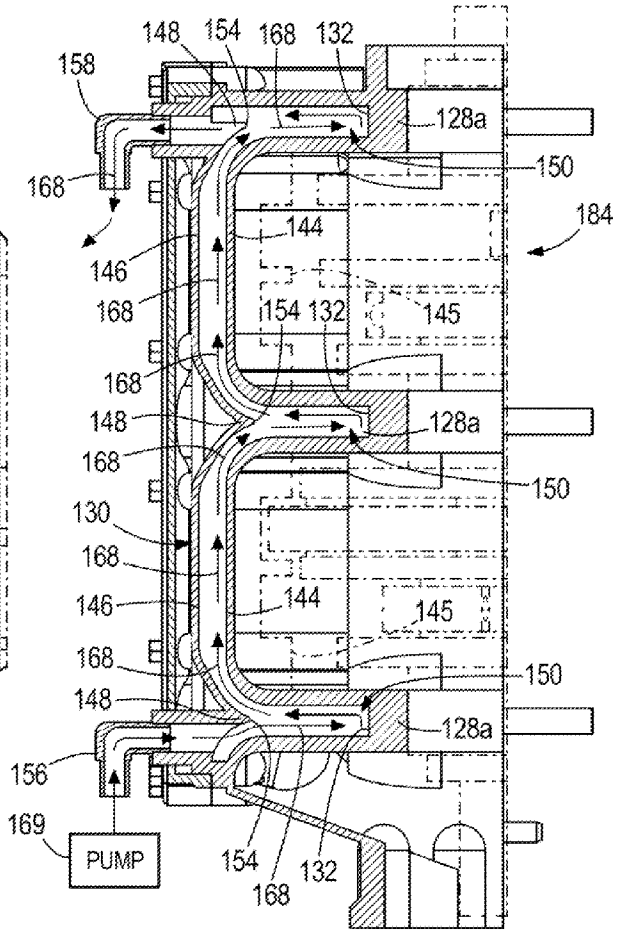
FIG. 9 is a view of section 9-9, taken in FIG. 7.
Figure 9A:
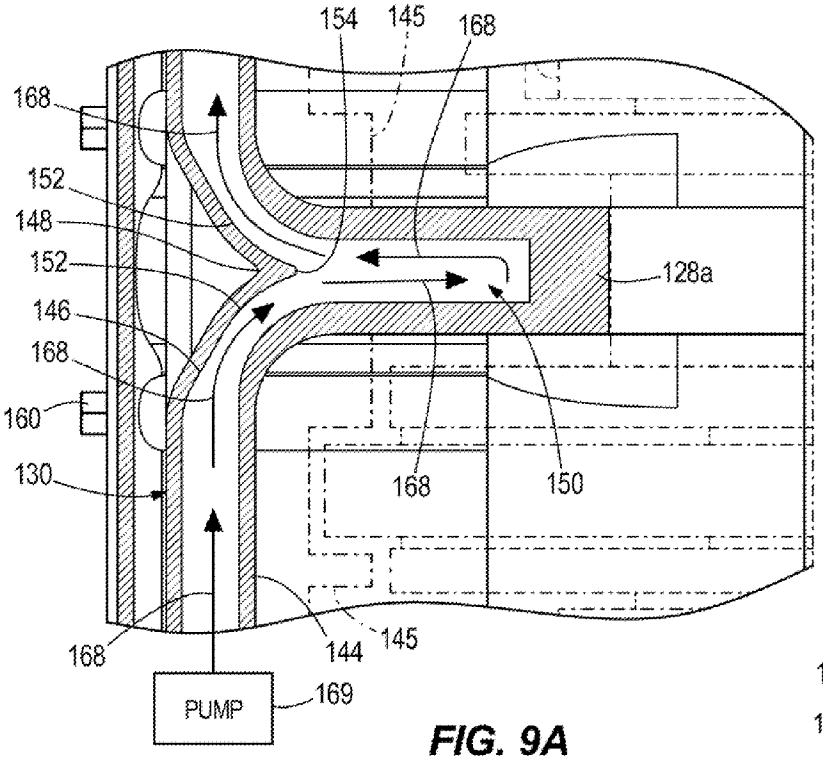
FIG. 9A is a closer view of a portion of FIG. 9.
Figure 10:
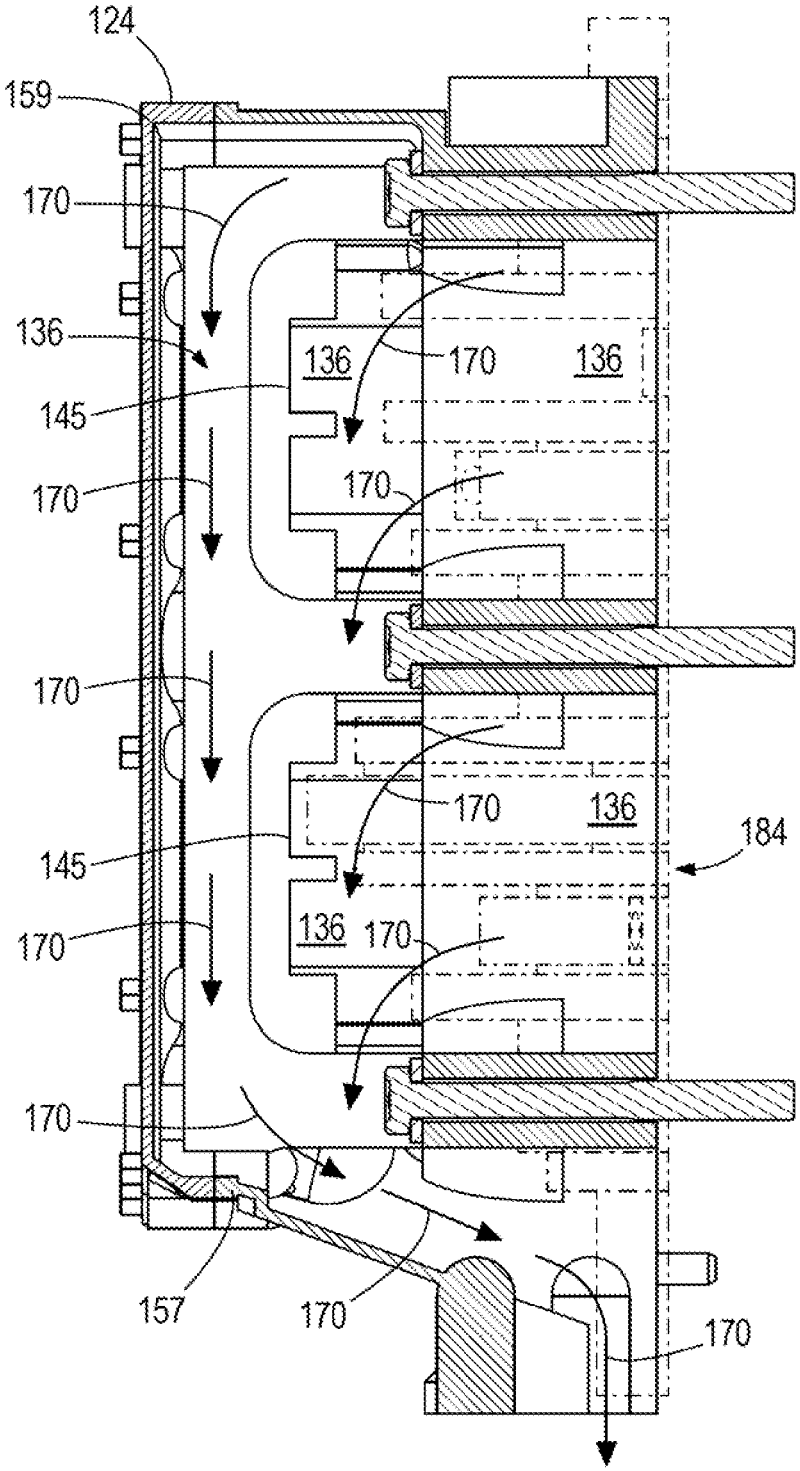
FIG. 10 is a view of section 10-10, taken in FIG. 7.
Figure 11:
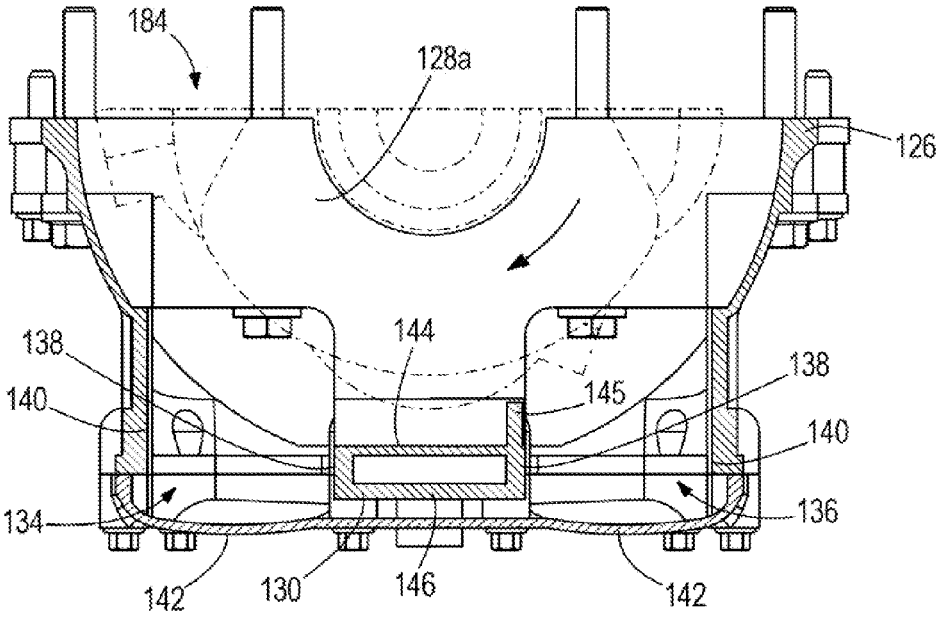
FIG. 11 is a view of section 11-11, taken in FIG. 7.
Figure 12:
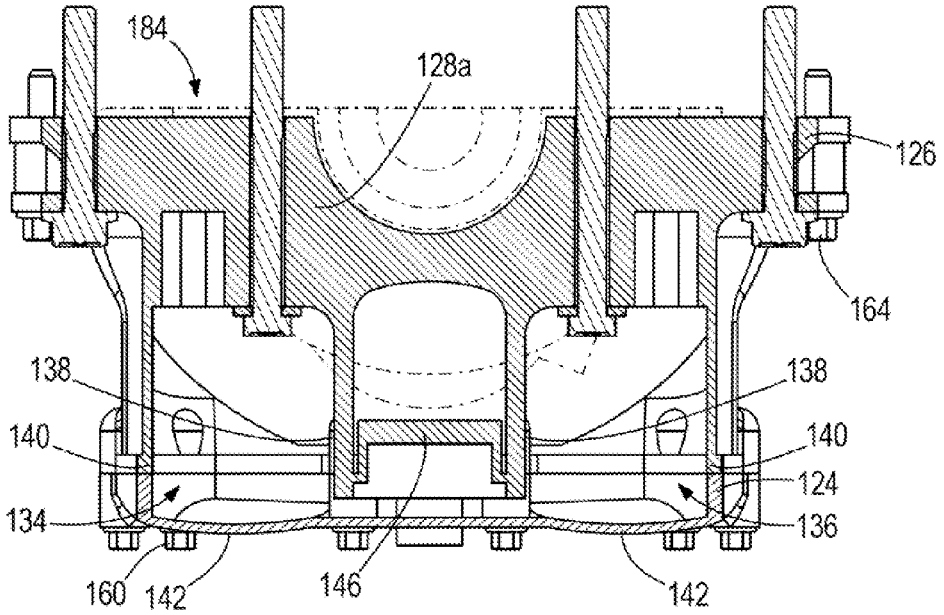
FIG. 12 is a view of section 12-12, taken in FIG. 7.
Figure 13:
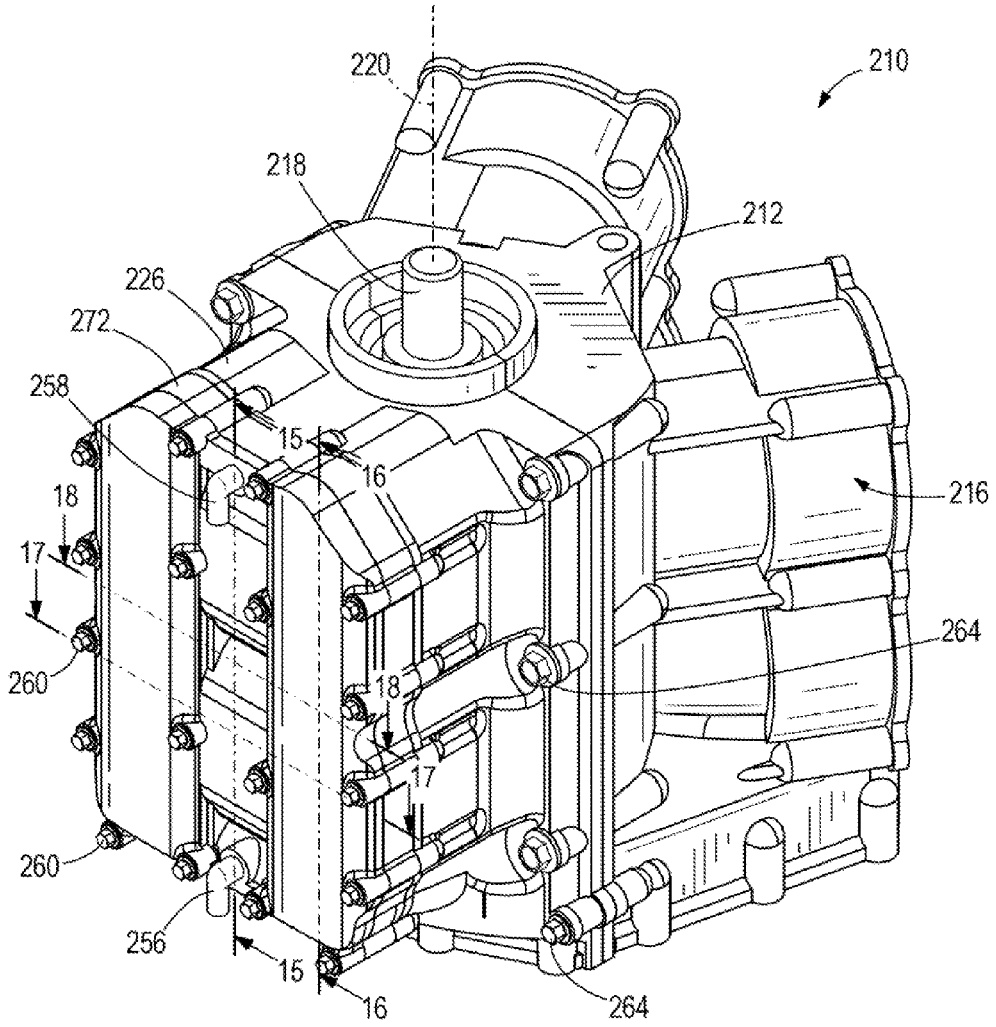
FIG. 13 is a perspective view of a third example of an outboard marine engine, including an engine block, bedplate, and cover assembly
Figure 14:
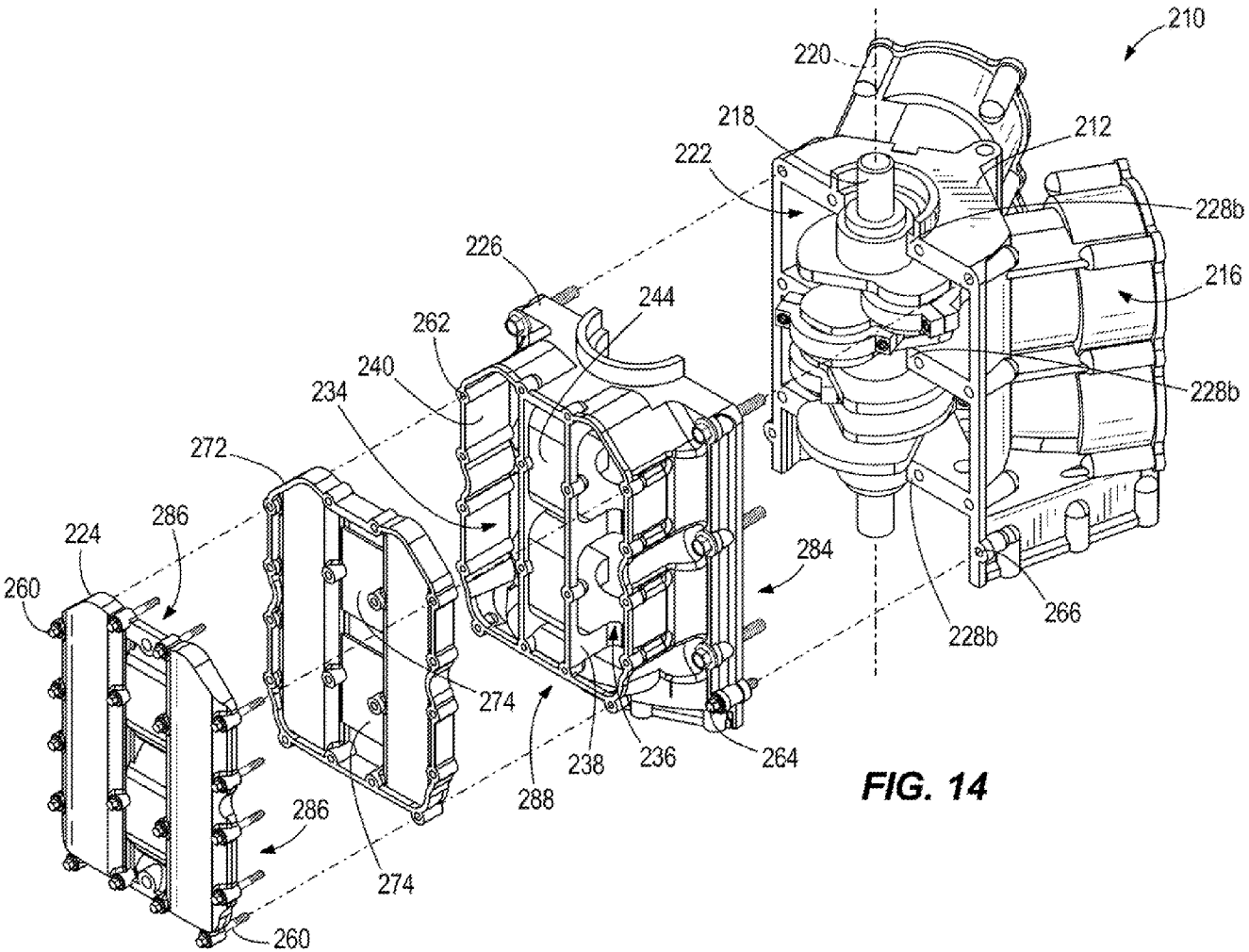
FIG. 14 is an exploded view of the assembly of FIG. 13.

As shown at arrows 70 in FIGS. 4-6, first and second oil drain-back areas 34, 36 are located adjacent to the cooling water jacket 30 and drain oil from the crankcase 22. In this example, the cooling water jacket 30 is located between the first and second oil drain-back areas 34, 36. The bedplate 26 has opposing inner and outer sidewalls 38, 40 that partially define the noted first and second oil drain-back areas 34, 36. The cover 24 has inner oil draining surfaces 42 that are located on opposite sides from each other with respect to the cooling water jacket 30 and partially define the first and second oil drain-back areas 34, 36. A plurality of scraper surfaces 45 extend radially inwardly from the bedplate 26 towards the crankshaft 18 and catch oil that is thrown by the crankshaft 18 during its rotation.

In use, as shown by arrows 68 in FIGS. 3 and 3A, a conventional cooling water pump 69 pumps raw seawater into the cooling water inlet 56, through the cooling water jacket 30, and out of the cooling water outlet 58. Rotation of the crankshaft 18 radially throws oil into the oil drain-back areas 34, 36. As shown at arrows 70 in FIG. 4, the oil drains by gravity, vertically downwardly to a sump (not shown) located below the engine block 12. Thus, the cooling water flows through the cooling water jacket 30 in a first (upward) direction and the oil drains from the crankcase 22 in an opposite (downward) second direction. The cooling water inlet 56 is located at one (e.g., the lower) end 57 of the crankcase 22 and the cooling water outlet 58 is located at the opposite (e.g., the upper) end 59 of the crankcase 22. In this manner, the cooling water is provided adjacent to all of the bearings 28 so as to efficiently providing cooling to all the bearings 28 in the engine block 12. The oil drain-back areas 34, 36 extend from the upper end 59 to the lower end 57 and thus efficiently drain oil from an entire vertical height of the crankcase 22.

The outboard marine engine 10 has been found by the present inventors to provide improved water cooling of all of the plurality of main bearings, thus reducing temperature and related thermal expansion of the bearings. Less clearance between the bearings and journals of the crankshaft can be provided, which results in less oil flow. Reducing oil flow reduces friction, which in turn reduces oil temperature. The need for cast iron caps to reduce flow can be avoided due to the decreased bearing temperature, which allows for less cost and weight. In some examples, the apparatus can be made of die cast aluminum, thereby reducing cost.

FIGS. 7-12 depict a second example of an outboard marine engine 110, in which in certain components can be formed by the use of salt core or sand core during the casting process. The outboard marine engine 110 is the same as the outboard marine engine 10 in many respects and thus corresponding reference numbers in a 100-series are provided on FIGS. 7-12 to indicate like structures. The outboard marine engine 110 differs from the outboard marine engine 10 in that the cooling water jacket 130 is entirely defined by the bedplate 126. The bedplate 126 defines both the outwardly directed cooling water jacket surface 144 and the inwardly directed cooling water jacket surface 146, as well as the noted deflectors 148. The cover 124 defines the noted inner oil draining surfaces 142 located on opposite sides of the cooling water jacket 130, similar to the outboard marine engine 10 shown in FIGS. 1-6. The inner oil draining surfaces 142 partially define the first and second oil drain-back areas 134, 136, similar to the outboard marine engine 10 shown in FIGS. 1-6.

Figure 15:
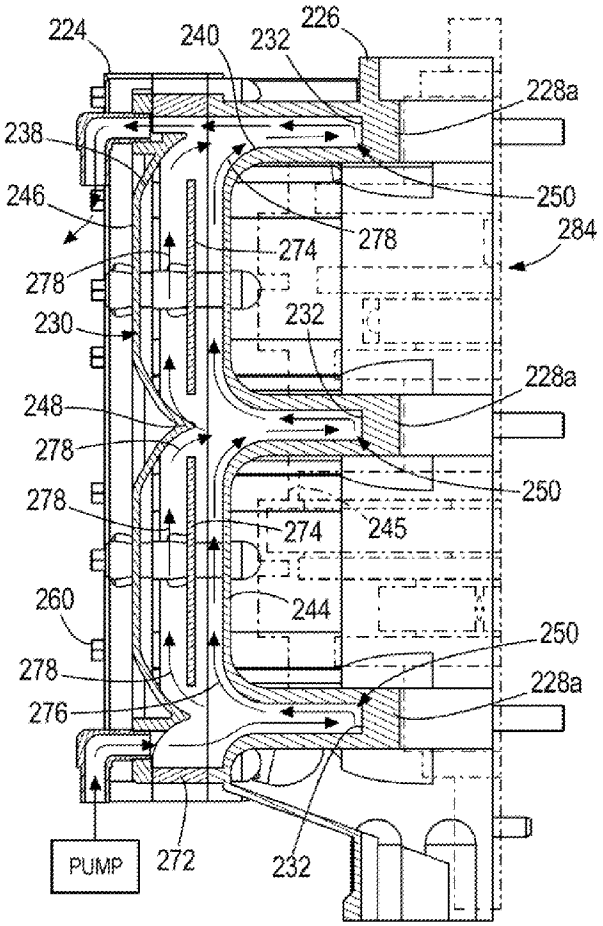
FIG. 15 is a view of section 15-15, taken in FIG. 13.
Figure 15A:
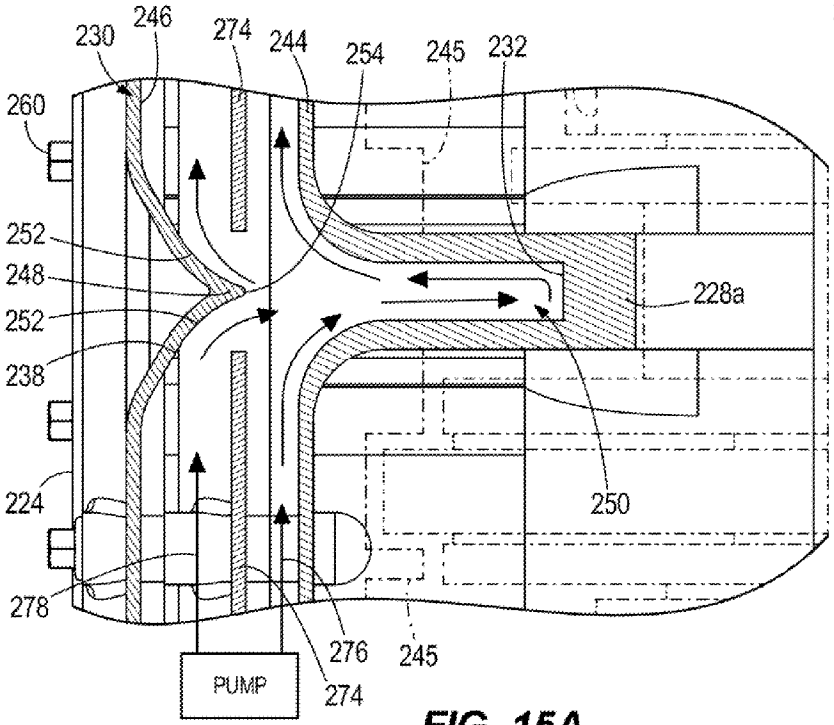
FIG. 15A is a closer view of a portion of FIG. 15.
Figure 16:
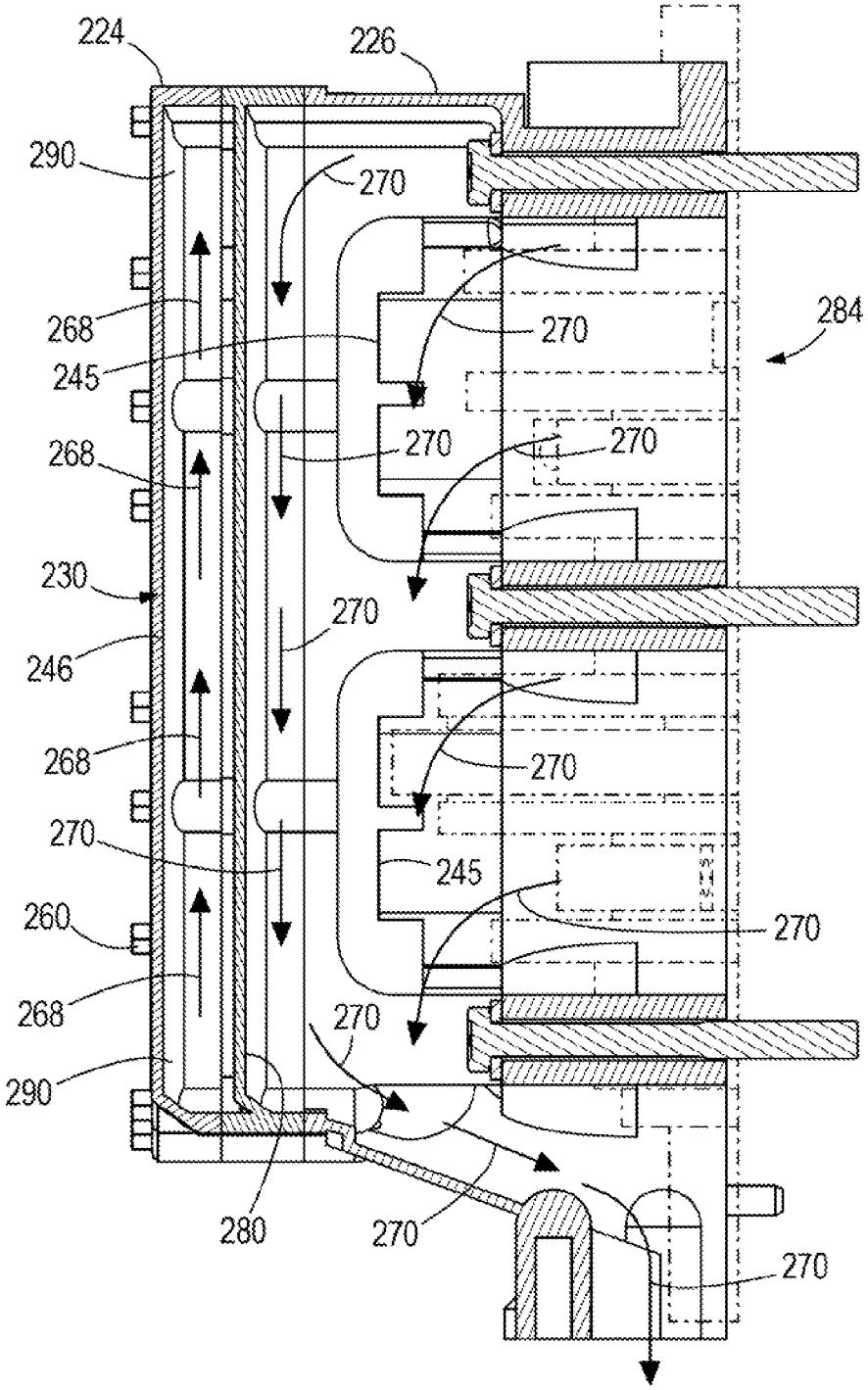
FIG. 16 is a view of section 16-16, taken in FIG. 13.
Figure 17:
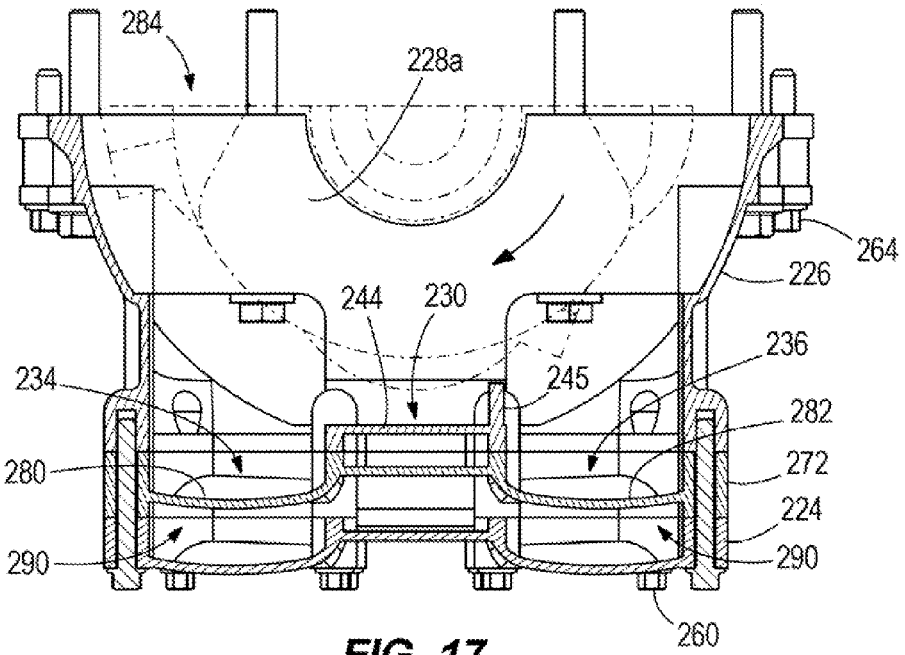
FIG. 17 is a view of section 17-17, taken in FIG. 13.
Figure 18:
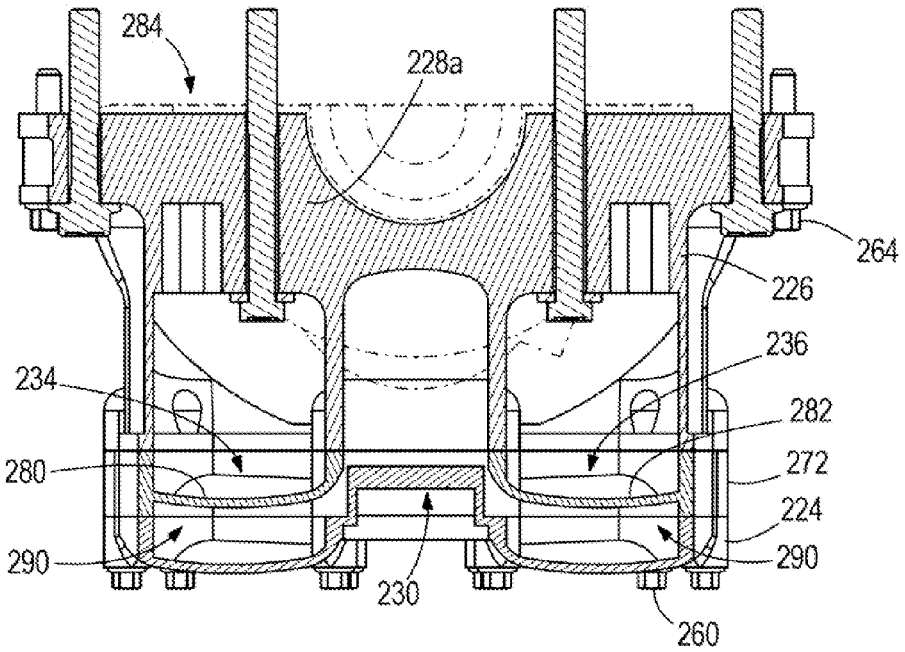
FIG. 18 is a view of section 18-18, taken in FIG. 13.

FIGS. 13-18 depict a third example of an outboard marine engine 210, which is similar in structure to the first and second examples 10, 110 shown in FIGS. 1-12. The outboard marine engine 210 is the same as the outboard marine engines 10, 110 in many respects and thus corresponding reference numbers in a 200-series are provided on FIGS. 7-12 to indicate like structures. The outboard marine engine 210 differs from the outboard marine engines 10 and 110 in that it includes a cooling plate 272, which is disposed between the cover 224 and bedplate 226. The cooling plate 272 defines intermediate portions of the cooling water jacket 230. More specifically, the cooling plate 272 defines a plurality of baffles 274 (see FIGS. 14, 15 and 15A) that divide cooling water flow into two separate vertical flow paths, at 276, 278, along the cooling water jacket 230, including a first inner flow path 276 and an adjacent, second outer flow path 278. The cooling water jacket 230 includes an outwardly directed cooling water jacket surface 244 and an opposing inwardly directed cooling water jacket surface 246 that is aligned with and faces the outwardly directed cooling water jacket surface 244. The outwardly directed cooling water jacket surface 244 is provided by the bedplate 226 and the inwardly directed cooling water jacket surface 246 is provided by the cover 224. The cooling plate 272 defines inner oil drainage surfaces 280, 282 (see FIGS. 16-18), which are located on opposite sides from each other with respect to the cooling water jacket 230. The inner oil draining surfaces 280, 282 partially define the noted first and second oil drain-back areas 234, 236. As shown in FIG. 16, the third example of the outboard marine engine 210 differs from the first and second examples 10, 110, in that cooling water enters into a space 290 behind the first and second oil drain-back areas 234, 236, allowing for enhanced cooling of these areas. This is shown at the arrows 268 in FIG. 16.

The present disclosure thus provides different examples of an outboard marine engine 10, 110, 210 having an engine block 12, 112, 212; a crankcase 22, 122, 222 on the engine block; a crankshaft 18, 118, 218 disposed in the crankcase for rotation about a crankshaft axis 20, 120, 220; a cover 24, 124, 224 on the crankcase; a bedplate 26, 126, 226 disposed between the engine block and the cover, the bedplate having a plurality of bearings 28, 128, 228 for supporting rotation of the crankshaft; and a cooling water jacket 30, 130, 230 that extends parallel to the crankshaft axis along radially outer portions 32, 132, 232 of the bearings. The cooling water jacket carries cooling water at 68, 168 and optionally 276, 278 for cooling the bearings 28, 128, 228. Oil drain-back areas 34, 36; 134, 136; 234, 236 are located adjacent to the cooling water jacket and drain oil from the crankcase. The cooling water jacket is located adjacent to each bearing in the plurality of bearings and in certain examples is located between the first and second oil drain-back areas.

In certain examples, the bedplate 26, 126, 226 has a radially inner side 84, 184, 284 that is fastened to the engine block 12, 112, 212. The cover has a radially inner surface 86, 186 that is fastened to a radially outer surface 88, 188 of the bedplate. In certain embodiments, a cooling plate 272 is disposed between a radially inner surface 286 of the cover and a radially outer surface 288 of the bedplate. In certain examples the cover and the bedplate at least partially define the cooling water jacket that carries cooling water for cooling bearings of the crankshaft. In certain examples, the bedplate and the radially inner side of the cover together define at least one oil drain-back area for receiving and draining oil that is radially thrown from the crankshaft during rotation.

In the foregoing description, certain terms have been used for brevity, clarity, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112(f) only if the terms "means for" or "step for" are explicitly recited in the respective limitation.

What is claimed is:

1. An outboard marine engine comprising:
an engine block;
a crankcase on the engine block;
a crankshaft disposed in the crankcase for rotation about a crankshaft axis;
a cover on the crankcase;
a bedplate disposed between the engine block and the cover, the bedplate having a plurality of bearings for supporting rotation of the crankshaft;
a cooling water jacket that extends parallel to the crankshaft axis along a radially outer portion of the plurality of bearings, the cooling water jacket carrying cooling water for cooling the plurality of bearings; and
at least one oil drain-back area located adjacent to the cooling water jacket, the at least one oil drain-back area draining oil from the crankcase;
wherein the at least one oil drain-back area comprises separate first and second oil drain-back areas; and
wherein the cooling water jacket is located between the first and second oil drain-back areas.

2. The outboard marine engine according to claim 1, wherein the bedplate comprises opposing inner and outer sidewalls that partially define the first and second oil drain-back areas.

3. The outboard marine engine according to claim 2, wherein the cover comprises inner oil draining surfaces located on opposite sides of the cooling water jacket, the inner oil draining surfaces partially defining the first and second oil drain-back areas.

4. The outboard marine engine according to claim 3, comprising a plurality of scraper surfaces that extend inwardly from the bedplate and catch oil thrown by the crankshaft during said rotation.

5. An outboard marine engine comprising:
an engine block;
a crankcase on the engine block;
a crankshaft disposed in the crankcase for rotation about a crankshaft axis;
a cover on the crankcase;

a bedplate disposed between the engine block and the cover, the bedplate having a plurality of bearings for supporting rotation of the crankshaft;

a cooling water jacket that extends parallel to the crankshaft axis along a radially outer portion of the plurality of bearings, the cooling water jacket carrying cooling water for cooling the plurality of bearings;

at least one oil drain-back area located adjacent to the cooling water jacket, the at least one oil drain-back area draining oil from the crankcase;

wherein the cooling water jacket comprises a radially outwardly directed cooling water jacket surface and an opposing radially inwardly directed cooling water jacket surface that is aligned with and faces the outwardly directed cooling water jacket surface; and a plurality of deflectors that are spaced apart along the inwardly directed cooling water jacket surface, the plurality of deflectors extending into a plurality of recesses that is formed in the outwardly directed cooling water jacket surface, wherein each recess in the plurality of recesses is located adjacent to a bearing in the plurality of bearings, the plurality of deflectors deflecting flow of cooling water into and out of the plurality of recesses.

6. The outboard marine engine according to claim 5, wherein each deflector in the plurality of deflectors comprises opposing curved surfaces that merge at a peak, the peak being located in a respective recess of the plurality of recesses.

7. An outboard marine engine comprising:

an engine block;

a crankcase on the engine block;

a crankshaft disposed in the crankcase for rotation about a crankshaft axis;

a cover on the crankcase;

a bedplate disposed between the engine block and the cover, the bedplate having a plurality of bearings for supporting rotation of the crankshaft;

a cooling water jacket that extends parallel to the crankshaft axis along a radially outer portion of the plurality of bearings, the cooling water jacket carrying cooling water for cooling the plurality of bearings; and at least one oil drain-back area located adjacent to the cooling water jacket, the at least one oil drain-back area draining oil from the crankcase;

wherein the cooling water jacket is partially defined by the bedplate and partially defined by the cover.

8. The outboard marine engine according to claim 7, wherein the cooling water jacket comprises an outwardly directed cooling water jacket surface and an opposing inwardly directed cooling water jacket surface that is aligned with and faces the outwardly directed cooling water jacket surface, wherein the outwardly directed cooling water jacket surface is provided by the bedplate, and wherein the inwardly directed cooling water jacket surface is provided by the cover.

9. An outboard marine engine comprising:

an engine block;

a crankcase on the engine block;

a crankshaft disposed in the crankcase for rotation about a crankshaft axis;

a cover on the crankcase;

a bedplate disposed between the engine block and the cover, the bedplate having a plurality of bearings for supporting rotation of the crankshaft;

a cooling water jacket that extends parallel to the crankshaft axis along a radially outer portion of the plurality of bearings, the cooling water jacket carrying cooling water for cooling the plurality of bearings;

at least one oil drain-back area located adjacent to the cooling water jacket, the at least one oil drain-back area draining oil from the crankcase; and a cooling water inlet located at a first end of the cooling water jacket and a cooling water outlet located at a second end of the cooling water jacket, wherein cooling water flows through the cooling water jacket in a first direction, and wherein oil drains from the crankcase in an opposite, second direction.

10. The outboard marine engine according to claim 9, wherein the cooling water jacket is located adjacent to each bearing in the plurality of bearings.

11. The outboard marine engine according to claim 9, wherein the at least one oil drain-back area comprises separate first and second oil drain-back areas.

12. The outboard marine engine according to claim 9, wherein the cooling water jacket comprises a radially outwardly directed cooling water jacket surface and an opposing radially inwardly directed cooling water jacket surface that is aligned with and faces the outwardly directed cooling water jacket surface.

13. The outboard marine engine according to claim 9, wherein the cooling water jacket is entirely defined by the bedplate.

14. An outboard marine engine comprising:

an engine block;

a crankcase on the engine block;

a crankshaft disposed in the crankcase for rotation about a crankshaft axis;

a cover on the crankcase;

a bedplate disposed between the engine block and the cover, the bedplate having a plurality of bearings for supporting rotation of the crankshaft;

a cooling water jacket that extends parallel to the crankshaft axis along a radially outer portion of the plurality of bearings, the cooling water jacket carrying cooling water for cooling the plurality of bearings; and at least one oil drain-back area located adjacent to the cooling water jacket, the at least one oil drain-back area draining oil from the crankcase; and a cooling plate disposed between the bedplate and the cover, the cooling plate defining portions of the cooling water jacket.

15. The outboard marine engine according to claim 14, wherein the cooling plate comprises a plurality of baffles that divide cooling water flow into two separate flow paths along the cooling water jacket, including a first inner flow path and a second outer flow path.

16. The outboard marine engine according to claim 15, wherein the cooling water jacket comprises an outwardly directed cooling water jacket surface and an opposing inwardly directed cooling water jacket surface that is aligned with and faces the outwardly directed cooling water jacket surface, wherein at least part of the outwardly directed cooling water jacket surface is provided by the bedplate and wherein at least part of the inwardly directed cooling water jacket surface is provided by the cooling plate.

17. The outboard marine engine according to claim 16, wherein the cooling plate comprises inner oil draining surfaces located on opposite sides of the cooling water jacket, the inner oil draining surfaces partially defining the first and second oil drain-back areas, and further comprising a space between the cooling plate and the inner oil draining surfaces and cover for receiving flow of cooling water.

18. An outboard marine engine comprising a crankshaft; an engine block that has a row of radially extending piston-cylinders; a bedplate having a radially inner side that is fastened to the engine block; and a cover having a radially inner surface that is fastened to a radially outer surface of the bedplate, wherein the cover and the bedplate at least partially define a cooling water jacket that carries cooling water for cooling bearings of a crankshaft; and wherein the bedplate and the radially inner side of the cover together define at least one oil drain-back area for receiving and draining oil that is radially thrown from a crankshaft during rotation.

* * * * *